US005392028A

United States Patent [19]

Pichl

[11] Patent Number: 5,392,028

[45] Date of Patent: Feb. 21, 1995

[54] ANTI-THEFT PROTECTION SYSTEMS RESPONSIVE TO BATH RESONANCE AND MAGNETIZATION

[75] Inventor: Fritz Pichl, Kilchberg, Switzerland

[73] Assignee: Kobe Properties Limited, Switzerland

[21] Appl. No.: 161,347

[22] Filed: Dec. 6, 1993

[30] Foreign Application Priority Data

Dec. 11, 1992 [CH] Switzerland ..... 3796/92

[51] Int. Cl.[6] ..... G08B 13/187

[52] U.S. Cl. ..... 340/572; 340/521; 340/551

[58] Field of Search ..... 340/572, 551, 521

[56] References Cited

U.S. PATENT DOCUMENTS

| | | | |
|---|---|---|---|
| 4,660,024 | 4/1987 | McMaster | 340/521 |
| 5,081,445 | 1/1992 | Gill et al. | 340/572 |
| 5,119,070 | 6/1992 | Matsumoto et al. | 340/572 |
| 5,204,527 | 4/1993 | Yamashita et al. | 340/551 |

*Primary Examiner*—Glen Swann

*Attorney, Agent, or Firm*—Laurence R. Brown

[57] ABSTRACT

Tagged articles are protected against theft by a system responding to articles having affixed thereto both a resonant circuit and a magnetizable strip. In one embodiment, a label alarm detector responds only to the presence of a resonant circuit or alternatively, only to the presence of a magnetizable strip. In a further embodiment, a label alarm detector responds to both presence of a resonant circuit and presence of a magnetizable strip.

9 Claims, 1 Drawing Sheet

ANTI-THEFT PROTECTION SYSTEMS RESPONSIVE TO BATH RESONANCE AND MAGNETIZATION

BACKGROUND OF THE INVENTION

1. Field of the Invention

The present invention relates to a method of protecting articles against theft by means of security devices to be mounted onto the articles to be protected, which security devices have resonant circuits affixed on a planar support and magnetizable strip material which together trigger an alarm by means of a detection system upon an unauthorized passing through a passageway.

The invention relates also to a security device for performing such a method.

DESCRIPTION OF THE PRIOR ART

Methods of protecting articles against theft are well known and have been used in practical applications with satisfactory results. The security devices are mounted, quite often at a central place during production onto or into the articles to be protected or are affixed to their wrappings and thereafter such articles are shipped to the stores for sale. This ensures also that all articles to be protected are equipped with security devices. This procedure involves, however, a serious drawback in that care must be taken at this central place that a security device is mounted which is specific for the particular purchaser, i.e. a security device which corresponds to the security system in the particular store. It is, thereby, quite obvious that a security system which operates with resonant labels (radio frequency) is able to respond to a corresponding alarm circuit only, and the same is true for the system with magnetic strips.

The central place which is responsible for equipping the security devices should be relieved from the risk of placing for given purchasers the correct or possibly wrong security device.

SUMMARY OF THE INVENTION

It is, therefore, a general object of the present invention to eliminate such a risk.

A further object is to provide a method wherein every article to be protected comprises a security device having both a resonant circuit and a magnetizable strip material. They might also both be deactivable.

Still a further object is to provide a method wherein two differently operating security labels are mounted directly over each other and are affixed to the article to be protected or to its wrapping, whereby preferably one of the devices is mounted directly under the other device, and thereby in a specifically suitable manner the two security devices are mounted on a carrier common to both, whereby this carrier can be formed by one of the two security devices itself.

Yet a further object is to provide a method, although at a higher expenditure, wherein instead of two different security devices to be placed onto the articles to be protected, the passageway which must be passed with an alarm circuit responding to the safety device on a protected article having either a resonant circuit or a magnetized strip material. In such a case quite obviously every article equipped with a safety device will excite the corresponding circuit upon an unauthorized passing through the passage and trigger the alarm. This saves the cost of placing two different security labels on the product.

A further object is to provide a device for performing the method in which a security device having both a resonant circuit in form of a thin label and a security device having a magnetizable strip material are mounted together on a support. This allows a simultaneous placing of the two safety devices onto the article to be protected.

Yet a further object is to provide a label in which both security devices are arranged on a common support either overlapping each other or placed side by side.

Still a further object is to provide a label in which the common support is formed by one of the two different security devices, which comprises adhesive on the side to be affixed the article to be protected.

DESCRIPTION OF THE PREFERRED EMBODIMENTS

Articles to be protected can be equipped with security devices in a simple manner and without a substantial expenditure, such that these devices can be used without any further measures independently from different protection systems which are in operation in the final user stores.

As a rule, the safety devices are deactivated at the location of payment (cash register). Thus, the device having a resonant circuit can be deactivated by passing through a resonant circuit deactivating apparatus. The safety device with a magnetic strip the deactivating proceeds also in a commonly known manner at a close distance along a magnet field serving the deactivating purpose.

The gist of the invention consists in that two respective safety devices are placed onto one article to be protected and which operate on different basic principles, namely by means of a resonant circuit or by means of magnetic strips. Other combinations of technology are also feasible. The safety devices can be placed onto the article to be protected on a carrier common to both, for instance formed by one of the safety devices and may possibly be covered there by a product label.

Obviously it is also possible to place the two safety labels onto the article at separate locations, however, according to the preferred manner the two differently operating safety devices are placed on top of each other at one and the same location.

As already mentioned, the basic object could be solved theoretically in that in place of two safety devices operating on different basic principles, the stationary passageway device in the store is equipped with an alarm circuit responding to different safety devices such that in any case an alarm is triggered upon an unauthorized passing through the passage. This variant is more complicated, costly and possibly also more prone to breakdowns. It also shall be mentioned, that safety devices of different kinds of operation, i.e. such on the basis of resonant circuits and such on the basis of magnetic strips located directly side by side do not influenc each other such that nothing prohibits a placing of the two safety devices over each other at the same place of the article to be protected.

Figure 1:
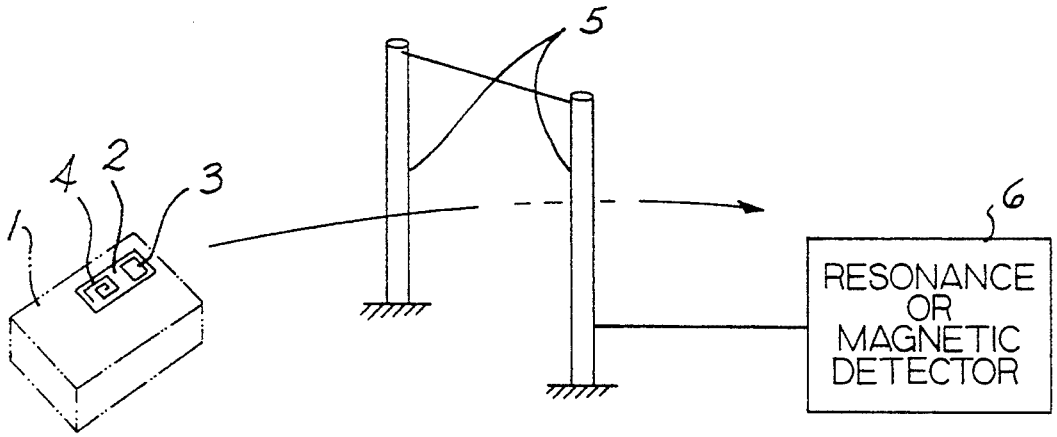
FIG. 1 is a sketch showing an article protected by two safety labels passing through a stationary detection system.

In FIG. 1, an article 1 is protected against theft by means of two different alarm labels 3 and 4 on a common support 2 which is adhesively affixed to the article 1. The alarm label 3 is magnetically detected and the alarm label 4 is a resonant circuit for resonance detection. The passage 5 is a conventional detector with accompanying detector 6 of either a resonance or a magnetic detector system.

Figure 2:
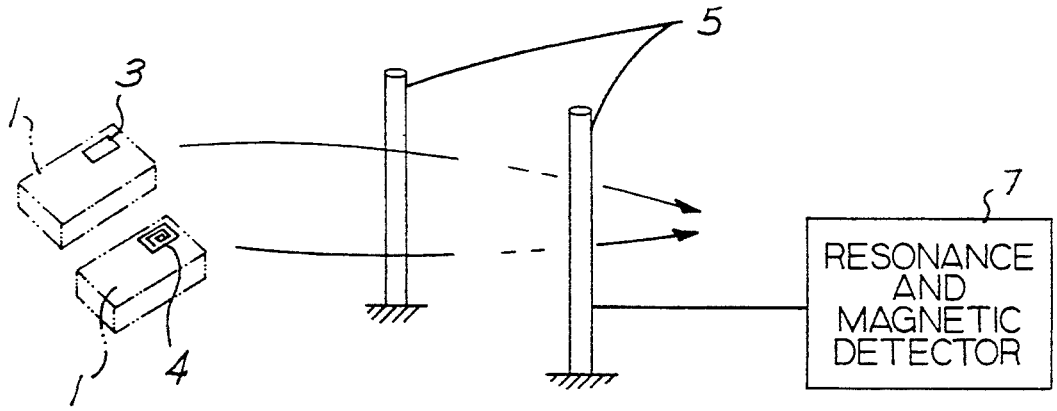
FIG. 2 is a sketch showing two different articles protected respectively by resonant circuit and magnetic security labels being processed by a detection system responsive to both resonant circuit and magnetic labels.

In FIG. 2, two separate articles 1 have respectively affixed thereto a magnetic alarm label 3 and a resonant alarm label 4. The passage 5 has an accompanying detector 7 that will respond to detect both resonance and magnetic alarm labels.

Figure 3:
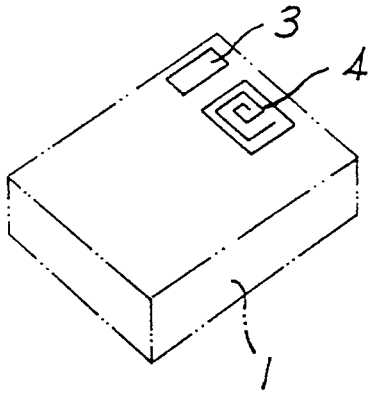
FIGS. 3 and 4 are sketches illustrating respective alternative embodiments of articles having two different alarm labels affixed thereto for detection respectively by resonance or magnetization detections.

In FIG. 3, the article 1 has two separate labels, namely a magnetic alarm label 3 and a resonant circuit label 4 separately affixed to the article 1 at different locations.

Figure 4:
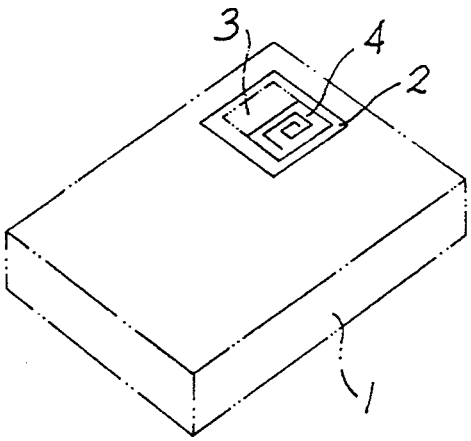

In FIG. 4, the article 1 has two labels, namely a magnetic alarm label 3 and a resonant circuit label 4, at least partially overlapped on the common carrier sheet 2 adhesively affixed to the article 1.

While there are shown and described preferred embodiments of the invention it is to be distinctly understood that the invention is not restricted thereto, but may be otherwise variously embodied and practiced within the scope of the following claims.

What is claimed is:

1. The method of protecting articles against theft by means of detection of security labels affixed to the articles upon unauthorized passing through a passageway to trigger an alarm in response thereto, comprising the step of:

producing an alarm responsive to the presence of either an unauthorized resonant circuit label or unauthorized magnetizable strip material on an article passing through said passageway.

2. The method of claim 1 further comprising the steps of:

affixing on the articles both a resonant circuit label and a magnetizable strip material, and passing those articles through a said passageway having a detector responsive to only one of the resonant circuit label or magnetizable strip material to produce an alarm upon unauthorized passing.

3. The method of claim 1 further comprising the steps of:

affixing separately on the articles only one label comprising a resonant circuit or a magnetizable strip material, and passing those articles through a passageway having a detector responsive to both resonant circuit labels and magnetizable strip material to produce an alarm upon unauthorized passing.

4. The method of claim 1 further comprising the step of affixing to the articles to be protected against theft two labels respectively comprising a resonant circuit and a magnetizable strip material.

5. An article for triggering an alarm upon an unauthorized passing through a passageway having an alarm circuit responsive to detect the presence of only one of a resonant circuit and a magnetizable strip, said article comprising in combination, both a resonant circuit and a magnetizable strip material security device affixed to the article.

6. The article of claim 5 further comprising, two separate labels affixed to the article.

7. The article of claim 5 further comprising, a common carrier affixed to said article common to both said resonant circuit and said magnetizable strip material.

8. The article of claim 7, further comprising adhesive means affixing said common carrier to said article.

9. The article of claim 7 further comprising means affixing the resonant circuit and the magnetizable strip material in overlapping positions on said common carrier.

* * * * *